United States Patent [19]

DeWitte

[11] 4,111,366

[45] Sep. 5, 1978

[54] SPINNER NOZZLE FOR USE IN COOLING TOWER

[75] Inventor: Richard Donald DeWitte, Healdsburg, Calif.

[73] Assignee: Dee-Mac Construction Co., Inc., Healdsburg, Calif.

[21] Appl. No.: 664,025

[22] Filed: Mar. 4, 1976

[51] Int. Cl.[2] ..... B05B 3/04

[52] U.S. Cl. ..... 239/222.17; 239/224; 261/DIG. 11; 416/237

[58] Field of Search ..... 239/222.17, 222.19, 239/222.11, 224; 261/DIG. 11; 169/37; 416/228, 237

[56] References Cited

U.S. PATENT DOCUMENTS

| | | | |
|---|---|---|---|
| 458,607 | 9/1891 | Weiss | 239/222.17 |
| 469,848 | 3/1892 | Best | 239/222.19 X |
| 974,176 | 11/1910 | Newman | 239/222.17 X |
| 2,260,301 | 10/1941 | Cushman | 239/108 |
| 3,888,313 | 6/1975 | Freeman | 169/37 X |

FOREIGN PATENT DOCUMENTS

| | | | |
|---|---|---|---|
| 1,408,572 | 7/1965 | France | 239/222.17 |
| 2,704 of | 1884 | United Kingdom | 239/222.17 |

*Primary Examiner*—Robert R. Song
*Assistant Examiner*—Michael Mar
*Attorney, Agent, or Firm*—Craig & Antonelli

[57] ABSTRACT

An improved nozzle for use in a cooling tower comprises a connecting member defining an orifice and a spinner rotably mounted on the connecting member so that liquid passing out of the orifice impinges on and thereby rotates the spinner. The spinner defines a plurality of arms projecting from a central section, each arm being spaced from adjacent arms by grooves or slots. The trailing edges of at least some of the arms are inclined at an angle of 10° to 25° with respect to the travel direction of liquid passing out of the orifice. With this construction, liquid to be cooled can be sprayed into the cooling tower in the form of a substantially uniform pattern of very fine droplets.

25 Claims, 8 Drawing Figures

SPINNER NOZZLE FOR USE IN COOLING TOWER

BACKGROUND OF THE INVENTION

The present invention relates to an improved nozzle for use in a cooling tower and in addition to a cooling tower equipped with this improved nozzle.

The construction and operation of cooling towers are well known in the art. In this regard, see Perry's Chemical Engineers Handbook, 4th Edition, McGraw-Hill Book Co., Inc., copyright 1963, pp. 15-14 to 15-23, the disclosure of which is incorporated herein by reference.

As is well known, cooling towers are used for cooling a liquid, usually water, which is used in a manufacturing plant or other facility for cooling the equipment being operated therein. Normally, a cooling tower includes a chamber for effecting contact between liquid falling through the chamber and air passing through the chamber. During intimate contact of the air and liquid, a portion of the liquid evaporates, thereby cooling the remaining liquid so that a cooler liquid product is obtained. In order to effect intimate contact between the liquid to be cooled and the air in the cooling tower, the liquid is normally formed into droplets prior to contacting air, this being done by spraying the liquid into an upper portion of the cooling tower chamber by means of one or more nozzles of suitable design.

As appreciated by those skilled in the art, the operating efficiency of a cooling tower is dependent, among other factors, upon the total surface area available for gas/liquid contact, i.e., the total surface area of all the liquid particles being contacted with air in the cooling tower chamber. Therefore, it is desirable to spray the liquid to be cooled in the cooling tower chamber in the form of fine droplets, since fine droplets present a very large total surface area of gas/liquid interface. On the other hand, if the liquid droplets become too small in size, as for example when the liquid forms a mist, they exhibit a tendency to be carried along with the air passing through the cooling tower chamber. If this should occur, a significant portion of the liquid introduced into the cooling tower will be lost from the system without providing a cooling effect. Consequently, it is also desirable that the particle size of the liquid particles is not too small.

Although different types of nozzles for use in cooling towers are available in the market at this time, most of these nozzles are disadvantageous for one reason or another. For example, most conventional nozzles are constructed in such a way that liquid passing therethrough forms an umbrella-like sheet as it falls away from the nozzle. The liquid in this umbrella-like sheet then breaks up into individual droplets as it travels farther away from the nozzle. Because the liquid emanating from the nozzle first forms an umbrella-like sheet before breaking up into particles, the total surface area of the gas/liquid interface remains small until the liquid travels a significant distance away from the nozzle. Also, because formation of droplets from the liquid in the umbrella-like sheet does not significantly alter the trajectory of the liquid, the liquid droplets tend to remain in an umbrella-like configuration, thereby causing the distribution of liquid droplets below the nozzle to be non-uniform. For these reasons, the heat-exchange efficiency of a cooling tower equipped with such a nozzle is reduced, and consequently the size of a cooling tower equipped with such a nozzle must be increased in order to realize a given cooling capacity.

Another disadvantage associated with many conventional nozzles for use in cooling towers is that they are subject to plugging and clogging. In many instances, the cooling liquid to be processed by a cooling tower contains corrosives and debris which will completely clog the tower nozzles during normal operation. Therefore, it is necessary in such installations to periodically shut down the cooling tower and clean the nozzles therein to prevent the nozzles from becoming completely clogged. This, of course, is disadvantageous not only because the operation of the cooling tower must be interrupted but also because cleaning of the nozzles can often be difficult and dangerous for maintenance personnel.

Accordingly, it is an object of the present invention to provide an improved nozzle for use in cooling towers which is capable of distributing the cooling liquid in the cooling tower chamber in such a way that the cooling capacity of the cooling tower is increased.

In addition, it is another object of the present invention to provide an improved nozzle for use in a cooling tower which will experience little or no clogging or plugging even when the liquid to be processed contains corrosives and debris.

A still further object of the present invention is to provide an improved nozzle for use in a cooling tower which is of simple construction and hence easy to manufacture.

Still another object of the present invention is to provide an improved cooling tower equipped with the cooling tower nozzle of the present invention.

SUMMARY OF THE INVENTION

These and other objects are accomplished by the present invention in accordance with which an improved nozzle for use in a cooling tower is provided. The improved nozzle of the present invention is composed of a connecting member which defines an orifice for passage of a liquid therethrough and a spinner rotably mounted on the connecting member. The spinner is mounted on the connecting member in such a way that liquid passing out of the orifice in the connecting member engages and thereby rotates the spinner. The spinner defines a plurality of arms projecting from a central portion thereof, each arm being spaced from adjacent arms by grooves or slots. The trailing edges of at least some of the arms of the spinner are inclined at an angle of 10° to 25° with respect to the travel direction of the liquid passing out of the orifice in the connecting member.

With this construction, it has been found that the tendency of the liquid passing out of the inventive nozzle to form an umbrella-like sheet, i.e., sheeting, is substantially completely eliminated. In addition, the tendency of the liquid passing out of the nozzle to form particles of extremely small particle size, i.e., misting, is also substantially completely eliminated. Moreover, liquid droplets formed as the liquid passes out of the inventive nozzle are distributed in a uniform manner. As a result, the cooling efficiency of a cooling tower provided with the inventive nozzle is improved compared with cooling towers equipped with conventional nozzles. Moreover, it has also been found that the spinning action of the spinner prevents the inventive nozzle from clogging even when the liquid processed contains corrosives and debris. Consequently, a cooling tower equipped with the inventive nozzle can be operated to process corrosive and debris-laden liquid for much longer periods of time prior to shut down for periodic cleaning than can cooling towers equipped with conventional nozzles.

BRIEF DESCRIPTION OF THE DRAWINGS

The present invention can be more easily understood by reference to the following drawings wherein.

DETAILED DESCRIPTION

Figure 6:
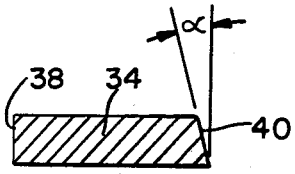
FIG. 6 is a cross-sectional view of one of the arms of the spinner of the improved nozzle of the present invention.
Figure 1:
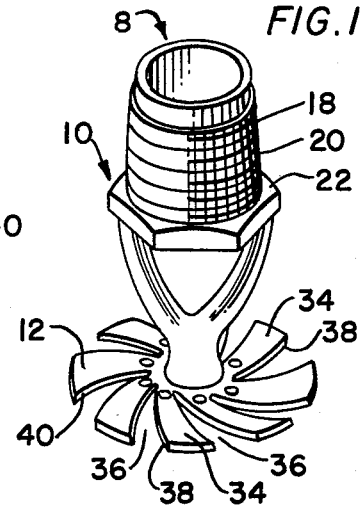
FIG. 1 is a perspective view of the improved nozzle of the present invention.

As shown in FIGS. 1 to 4, the improved nozzle 8 of the present invention comprises a connecting member 10 and a spinner 12 rotably mounted on connecting member 10 by means of a screw 14 and a washer 16. In accordance with the preferred embodiment of the present invention, washer 16 is made from a plastic or metal while both connecting member 10 and spinner 12 are metal or plastic and are made by a suitable molding or casting operation. Connecting member 10 defines a conduit section 18, which as illustrated in the drawings, is cylindrical in configuration and externally threaded at 20. In addition, conduit section 18 is provided at its base with nut portion 22 for facilitating threaded tightening of the inventive nozzle into a connecting conduit or the like. Conduit section 18 further defines at a lower portion thereof an orifice 24 for the passage of the liquid to be cooled out of the connecting member.

Downwardly depending from nut portion 22 of connecting member 10 are legs 26 and 28, which terminate in shank 30. Shank 30 is provided with a shaft 15, which in turn, is provided with a threaded opening (not shown) for receiving screw 14. If connecting member 10 is metal, shaft 15 is molded onto shank 30. If connecting member is plastic, shaft 15 is heat riveted to retain washer 16.

Figure 5:
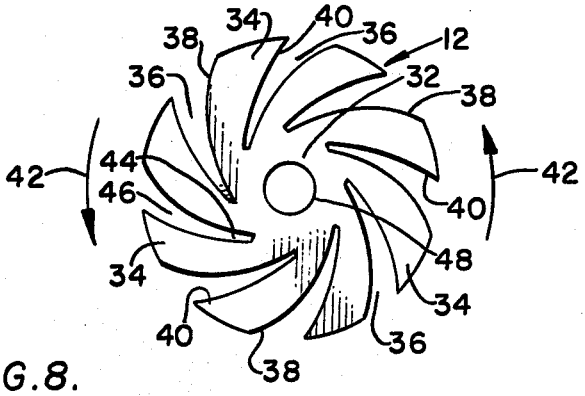
FIG. 5 is a bottom view of the spinner of the inventive nozzle.
Figure 8:
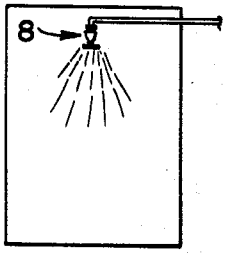
FIG. 8 is a schematic view illustrating the use of the inventive nozzle to spray a liquid into the cooling tower chamber of a cooling tower.
Figure 3:
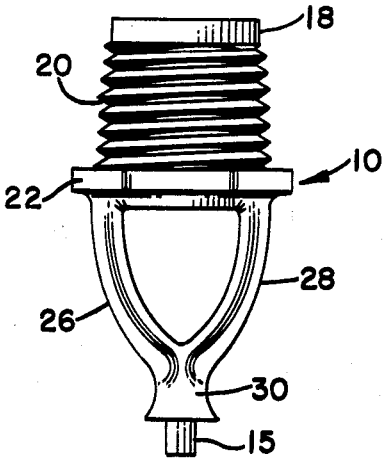
FIG. 3 is a view similar to FIG. 2 showing the connecting member only of the inventive nozzle.
Figure 4:
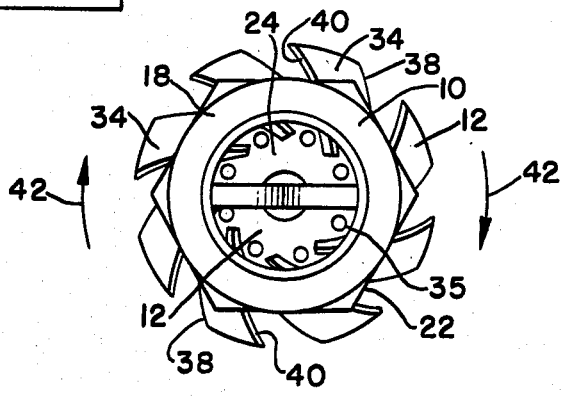
FIG. 4 is an elevational view of the improved nozzle shown in FIG. 1.

As illustrated in FIGS. 1, 4, 5 and 7, spinner 12 is planar in configuration and composed of a central section 32 and a plurality of arms 34. Each of arms 34 is spaced from adjacent arms by slots 36 extending through the plate-form of the spinner 12, as seen in the drawing figures, so that each arm defines a leading edge 38 and a trailing edge 40 with respect to the motion direction of the spinner as shown by arrows 42. As illustrated in the figures, the width of each of slots 36 continuously increases in size from a narrow portion 44 adjacent the central section of the spinner to a broad portion 46 remote from the central section of the spinner. Also, it will be noted that slots 36 are arcuate in configuration and arranged such that the narrow portion 44 of each slot is radially forward of the broad portion 46 of that slot with respect to the motion direction of the spinner as illustrated by arrows 42. As shown in FIG. 5, spinner 12 is provided with a hole 48 in its center for receiving screw 14 in order that spinner 12 can be mounted on connecting member 10.

Figure 7:
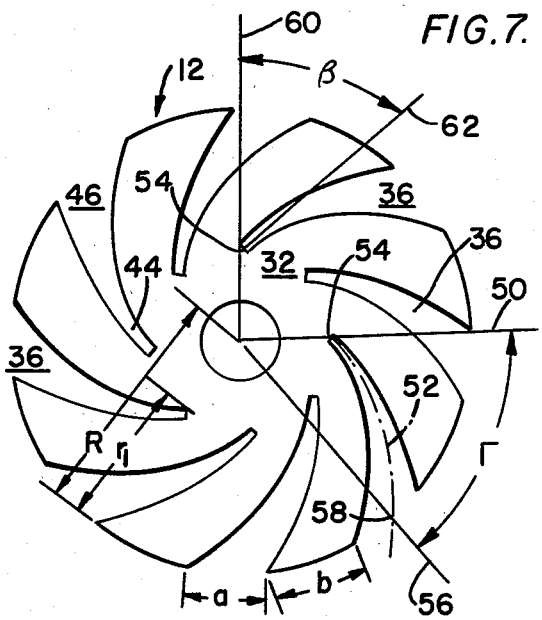
FIG. 7 is a view similar to FIG. 5 illustrating in more detail the construction of the spinner of the inventive nozzle.
Figure 2:
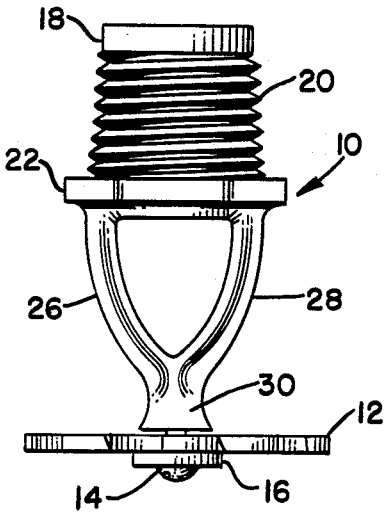
FIG. 2 is a front view of the improved nozzle of FIG. 1.

Referring to FIG. 7, the preferred dimensional configuration of spinner 12 will be described. In its preferred mode, spinner 12 is essentially circular in configuration. Slots 36 extend from the outer periphery of the spinner toward the center thereof by a distance $r_1$ which is preferably $\frac{1}{2}$ to $\frac{2}{3}$ of the distance R between the outer periphery and the center of the spinner. In addition, slots 36 are so shaped that the angle $\Gamma$ between a first radius 50 of the spinner passing through the centerline 52 of a slot at the inside end 54 of the slot and a second radius 56 passing through the centerline 52 of the same slot at the periphery of the spinner is 35° to 70°, preferably 48° to 54°. Furthermore, the angle $\beta$ between radially extending line 60 and tangent 62 which is tangential to centerline 52 at the inside end 54 of slot 36 is 30° to 60°, preferably 40° to 50°. Also, the ratio of the width of narrow portion 44 of slot 36 to broad portion 46 of slot 36 is $\frac{1}{2}$ to 6, preferably 1 to 5. Finally, the ratio $a/b$ of the width of broad portion 46 of slot 36 to the width of arm 34 at the outer periphery of the spinner on its upper face is 1 to 2, preferably 1 to 1.

In accordance with the present invention, as illustrated in FIG. 6, the trailing edges 40 of at least some and preferably all of arms 34 are inclined at an angle $\alpha$ of 10° to 25°, preferably 15°, with respect to the travel direction of liquid passing out of connecting member 10, which direction is perpendicular to the plane of spinner 12. Also, leading edges 38 of arms 34 as shown in FIG. 6 are preferably perpendicular to the plane of spinner 12 and hence parallel to the motion direction of liquid passing out of connecting member 10. With this construction, the inventive nozzle is capable of substantially completely breaking up the liquid stream passing out of connecting member 10 into droplets small enough to effect good heat transfer but large enough to prevent misting immediately as the liquid stream impinges upon spinner 12. If the angle $\alpha$ is significantly above 25°, the liquid passing out of connecting member 10 will tend to form an umbrella-like sheet whereas if angle $\alpha$ is significantly below 10°, significant misting will occur. However, by maintaining angle $\alpha$ between 10° and 25°, preferably 15°, neither sheeting nor misting will occur and moreover the liquid droplets produced by the action of spinner 12 will be uniformly distributed as they fall through the cooling tower chamber. As a result, a cooling tower equipped with the improved nozzle of the present invention will operate with an excellent heat transfer efficiency, and consequently the size of the cooling tower can be reduced vis a vis conventional cooling towers with conventional nozzles. Furthermore, because of the spinning action of the spinner 12, clogging of the inventive nozzle because of corrosives or debris in the liquid being processed will be substantially completely eliminated.

Although only a single embodiment of the present invention has been described above, it should be appreciated that many modifications can be made without departing from the spirit and scope of the invention. For example, although connecting member 10 and spinner 12 of the inventive nozzle described above are made of metal, they can be made from any suitable rigid material such as, for example, a plastic. Also although the foregoing description indicates that connecting member 10 and spinner 12 are made by molding or casting, they can be made by any other technique capable of forming integral, unitary structural members of the desired configuration. All such modifications are intended to be included within the scope of the invention, which is to be limited only by the following claims.

What is claimed is:

1. A nozzle comprising a connecting member and a spinner rotatably mounted on said connecting member, said connecting member defining an orifice for passage of fluid therethrough, and mounting means for mounting said spinner so that fluid passing out of said orifice engages and rotates said spinner, said spinner defining a central section and a plurality of arms projecting from said central section, each arm being spaced from adjacent arms by slots extending through said spinner, said slots respectively defined by the trailing edge of one arm and the leading edge of an adjacent arm, the trailing edge of at least some of said arms being inclined at an angle of 10° to 25° with respect to the travel direction of fluid passing out of said orifice, the leading edges of said at least some arms being parallel with respect to the travel direction of fluid passing out of said orifice, wherein the upper surfaces of at least some arms are flat surfaces which lie in the same plane, and wherein said upper surfaces are arranged transverse to the travel direction of fluid passing out of said orifice such that said upper surfaces have a greater dimension perpendicular to the travel direction of fluid passing out of said orifice than parallel thereto.

2. The nozzle of claim 1 wherein the trailing edges of all of said arms are inclined at an angle of 10° to 25° with respect to said travel direction.

3. The nozzle of claim 2 wherein said arms and said slots are coplanar, and further wherein the width of each slot continuously increases in size from a narrow portion adjacent the central section of said spinner to a broad portion remote from said central section.

4. The nozzle of claim 3 wherein said slots are arcuate.

5. The nozzle of claim 4 wherein said slots are arranged such that the narrow portion of each slot is radially forward of the broad portion of said slot with respect to the motion direction of said spinner.

6. The nozzle of claim 4 wherein the angle between a first radius of said spinner passing through the centerline of at least one of said slots at the inside end thereof and a second radius passing through the centerline of said slot at the periphery of said spinner is from 35° to 70°.

7. The nozzle of claim 4 wherein said slots are so arranged that a straight line tangential to the centerline of each slot at the inside end thereof is arranged at an angle of 30° to 60° with respect to a radius of said spinner passing through said centerline at the inside end of each of said slot.

8. The nozzle of claim 4 wherein said spinner is mounted perpendicular to said travel direction.

9. The nozzle of claim 8 wherein the ratio of the width of the broad portion of each slot to the width of each arm at the end thereof remote from the central section of said spinner is 1 to 2.

10. The nozzle of claim 8 wherein the width of the broad portion of each slot is substantially equal to the width of each arm at the end thereof remote from the central portion of said spinner.

11. The nozzle of claim 8 wherein said mounting means mounts said spinner at a fixed distance from said orifice.

12. The nozzle of claim 3 wherein said slots radially extend from the outer periphery of said spinner toward the center of said spinner a distance ½ to ⅔ the radial distance between the center and outer periphery of said spinner.

13. In a cooling tower including a chamber for effecting contact between a downflowing liquid and a gas, and nozzle means for spraying a liquid to be cooled into an upper part of said chamber, the improvement wherein said nozzle means comprises a connecting member and a spinner rotatably mounted on said connecting member, said connecting member defining an orifice for passage of said liquid therethrough and mounting means for mounting said spinner so that liquid passing out of said orifice engages and rotates said spinner, said spinner defining a central section and a plurality of arms projecting from said central section, each arm being spaced from adjacent arms by slots extending through said spinner, said slots respectively defined by the trailing edge of one arm and the leading edge of an adjacent arm, the trailing edges of at least some of said arms being inclined at an angle of 10° to 25° with respect to the travel direction of liquid passing out of said orifice, wherein the upper surfaces of at least some of said arms are flat surfaces which lie in the same plane, and wherein said upper surfaces are arranged transverse to the travel direction of fluid passing out of said orifice such that said upper surfaces have a greater dimension perpendicular to the travel direction of fluid passing out of said orifice than parallel thereto.

14. An improved cooling tower according to claim 13, wherein said spinner includes a disk member having said central section mounted on a shaft, and said plurality of arms projecting from said central section in the plane of said disk member.

15. An improved cooling tower according to claim 14, wherein the trailing edges of all of said arms are inclined at an angle of 10° to 25° with respect to said travel direction.

16. An improved cooling tower according to claim 15, wherein said disk member is mounted with said plane perpendicular to said direction of travel.

17. An improved cooling tower according to claim 15, wherein the leading edges of all of said arms are perpendicular to said plane of said disk member.

18. An improved cooling tower according to claim 14, wherein each of said slots have a width continuously increasing in size from said central section to the periphery of said disk member.

19. An improved cooling tower according to claim 18, wherein said slots are arcuate.

20. An improved cooling tower according to claim 19, wherein the angle between a first radius of said disk member passing through the centerline of at least one of said slots at the inside end thereof and a second radius passing through the centerline of said slot at the periphery of said disk member is from 35° to 70°.

21. An improved cooling tower according to claim 19, wherein said slots are so arranged that a straight line tangential to the centerline of each slot at the inside end thereof is arranged at an angle of 30° to 60° with respect to a radius of said disk member passing through said centerline at the inside end of each of said slot.

22. An improved cooling tower according to claim 18, wherein the ratio of the width of said slots at said periphery to the width of said arms at said periphery is 1 to 2.

23. An improved cooling tower according to claim 18, wherein the width of said slots at said periphery is substantially equal to the width of said arms at said periphery.

24. An improved cooling tower according to claim 18, wherein said slots extend radially from said periphery of said disk member toward said center section a distance ½ to ⅔ of the radius of said disk member.

25. An improved cooling tower according to claim 14, wherein said mounting means mounts said disk member at a fixed distance from said orifice.

* * * * *